United States Patent [19]

Zaborowski

[11] Patent Number: 4,699,123

[45] Date of Patent: Oct. 13, 1987

[54] PORTABLE HEATING APPLIANCE

[75] Inventor: Thaddeus Zaborowski, Cambridge, Mass.

[73] Assignee: The Schawbel Corporation, Cambridge, Mass.

[21] Appl. No.: 825,275

[22] Filed: Feb. 3, 1986

Related U.S. Application Data

[63] Continuation-in-part of Ser. No. 781,262, Sep. 27, 1985.

[51] Int. Cl.[4] ..... A45D 1/02

[52] U.S. Cl. ..... 126/409; 132/33 R; 132/37 R; 431/89; 431/285; 431/344

[58] Field of Search ..... 126/208, 229, 231, 232, 126/351, 408, 409; 236/92 A; 251/78, 236–238, 242, 321; 31/89, 90, 278, 285, 344; 132/33 R, 37 R

[56] References Cited

U.S. PATENT DOCUMENTS

| | | | |
|---|---|---|---|
| 3,181,789 | 5/1965 | Hill | 236/92 A X |
| 3,574,506 | 4/1971 | Locke | 431/349 |
| 3,887,325 | 6/1975 | Finger et al. | 431/6 |
| 4,243,017 | 1/1981 | Diederich | 126/409 |
| 4,382,448 | 5/1983 | Tittert | 132/33 R |
| 4,502,465 | 3/1985 | Yoshinaga et al. | 126/409 |

FOREIGN PATENT DOCUMENTS

| | | | |
|---|---|---|---|
| 2390678 | 1/1979 | France | 431/344 |
| WO83/279 | 2/1983 | PCT Int'l Appl. | 126/408 |

*Primary Examiner*—Samuel Scott
*Assistant Examiner*—Allen J. Flanigan
*Attorney, Agent, or Firm*—Peter L. Berger

[57] ABSTRACT

A portable heating appliance having a member to be heated, includes burner tubes for heating the member; a fuel supply cartridge for supplying fuel to the burner tubes, the cartridge including a stationary fuel delivery valve for controlling the flow of fuel from the cartridge; and an actuator assembly for actuating the fuel delivery valve in response to user actuation to start the flow of fuel from the cartridge, the actuator assembly including a plunger, a mechanism for moving the plunger to a first position into operative engagement with the fuel delivery valve for opening the fuel delivery valve and a mechanism for moving the plunger to a second position out of operative engagement with the fuel delivery valve so that the latter terminates the flow of fuel to the burner tubes. The mechanism for moving the plunger to a second position incudes a pivotally mounted lever; a spring for biasing the lever in a first direction; a switch for biasing the lever in a second, opposite direction against the force of the spring; a ring secured to the plunger; and a slidably mounted shaft movable by the lever into engagement with the ring to move the plunger to the second position when the switch biases the lever in the second direction.

23 Claims, 8 Drawing Figures

PORTABLE HEATING APPLIANCE

REFERENCE TO RELATED APPLICATION

The present application is a Continuation-In-Part of U.S. patent application Ser. No. 06/781,262, filed Sept. 27, 1985, entitled Portable Curling Iron to the same inventors herein.

BACKGROUND OF THE INVENTION

This invention relates generally to portable heating appliances and, more particularly, is directed to a novel portable curling iron.

A curling iron curls hair by wrapping the hair, tress by tress, around a heated barrel, holding the wrapped tress for a period of time and then unwrapping the tress. The length of time the hair is held wrapped around the barrel, the temperature, the diameter of the barrel and the hair's characteristics largely determine the tightness of the curl.

Some curling irons are portable. These heat the barrel by an electrical heat source or a portable fuel source. Electrical portable curling irons are relatively impractical, but catalytic gas powered curling irons are widely employed. The catalytic converters thereof are powered by butane or similar type gases which may take the form of replaceable or refillable cartridges. Such portable curling irons are widely used, and may be conveniently used almost anywhere.

Catalytic burners for portable curling irons suffer from several disadvantages. First, they are slow to heat and expensive to manufacture, which are clearly undesirable. Additionally, if the temperature runs too high, the platinum catalyst sinters, reducing surface area, which reduces life.

Still further, catalytic converters can suffer from "hot spots" which can render them dangerous.

OBJECTS AND SUMMARY OF THE INVENTION

Accordingly, it is an object of this invention to provide a system for portable devices requiring a heated portion which eliminates the above-mentioned problems.

It is another object of this invention to provide such a system which may be advantageously used in curling irons.

It is still another object of this invention to provide such a system which may be used with portable irons, portable hot trays, hair roller setters, portable bottle warmers as well as many other portable products.

It is yet another object of this invention to provide such a system which is readily adaptable to portable use, yet which permits rapid heating of the element to be heated.

It is a further object of this invention to provide such a system in which the operating temperature is maintained substantially constant.

It is a still further object of this invention to provide such a system in which a source of fuel is employed which may be rechargeable or refillable.

It is a yet further object of this invention to provide such a system in which the element to be heated rapidly achieves the desired temperature, yet in which the temperature is maintained with decreased fuel consumption.

It is another object of this invention to provide such a system which is safe to use.

It is still another object of the present invention to provide such a system in which a removable fuel supply cartridge is provided.

It is yet another object of the present invention to provide such a system in which a plunger is moved toward and away from the stationary fuel supply cartridge for actuating a fuel delivery valve therein.

It is a further object of the present invention to provide such a system in which a burner nozzle is inserted in the burner tubes to provide a cleaner and more efficient burning operation.

It is a still further object of the present invention to provide such a system in which loosening of the fuel delivery valve in the cartridge is prevented.

In accordance with the principles of this invention, the above objects are accomplished by providing a fuel delivery and ignition system for a portable heating appliance which quickly heats the working surface and then reduces the fuel flow when the desired temperature is reached. Additionally, a regulator is provided which controls the fuel rate to maintain a substantially constant temperature of the working surface. Specifically, a piezoelectric ignitor is provided to initially ignite the two burners. After the desired surface temperature is reached, one of the burners is turned off, and the remaining burner continues to operate and maintain the surface temperature substantially constant.

Specifically, a portable heating appliance having a member to be heated, includes burner means for heating the member; fuel supply means for supplying fuel to the burner means, the fuel supply means including stationary fuel delivery valve means for controlling the flow of fuel from the fuel supply means; and actuator means for actuating the fuel delivery valve means in response to user actuation to start the flow of fuel from the fuel supply means, the actuator means including a plunger, means for moving the plunger to a first position into operative engagement with the fuel delivery valve means for opening the fuel delivery valve means and means for moving the plunger to a second position out of operative engagement with the fuel delivery valve means so that the latter terminates the flow of fuel to the burner means.

The means for moving the plunger to a second position includes a pivotally mounted lever; spring means for biasing the lever in a first direction; switch means for biasing the lever in a second, opposite direction against the force of the spring means; abutment means secured to the plunger; and slidably mounted shaft means movable by the lever into engagement with the abutment means to move the plunger to the second position when the switch means biases the lever in the second direction.

The above and other, objects, features and advantages of the present invention will become readily apparent from the following detailed description which is to be read in connection with the accompanying drawings.

DETAILED DESCRIPTION OF THE PREFERRED EMBODIMENTS

Figure 1:
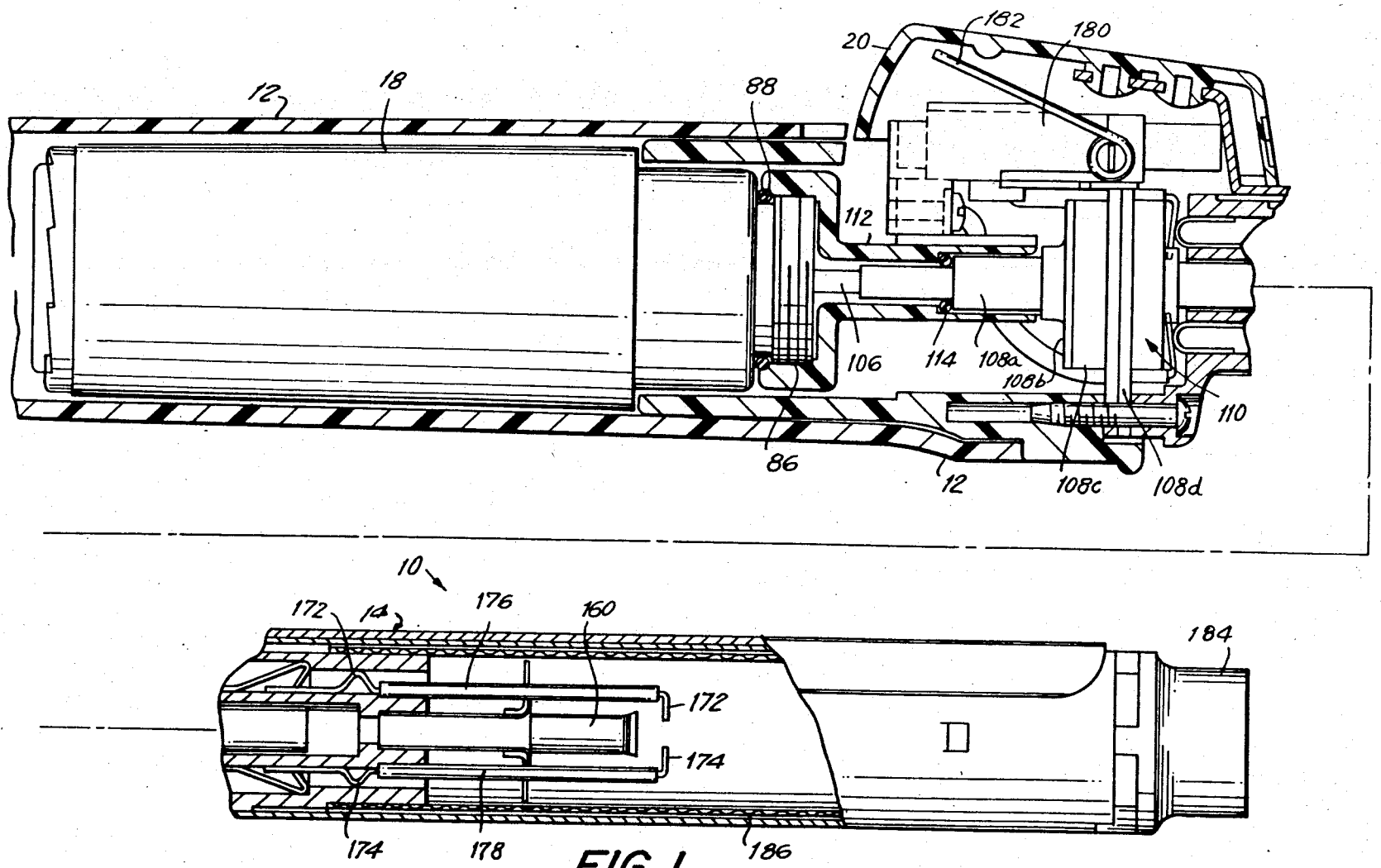
FIG. 1 is a partial cross-sectional view of a portable curling iron according to the present invention in its operative condition.
Figure 2:
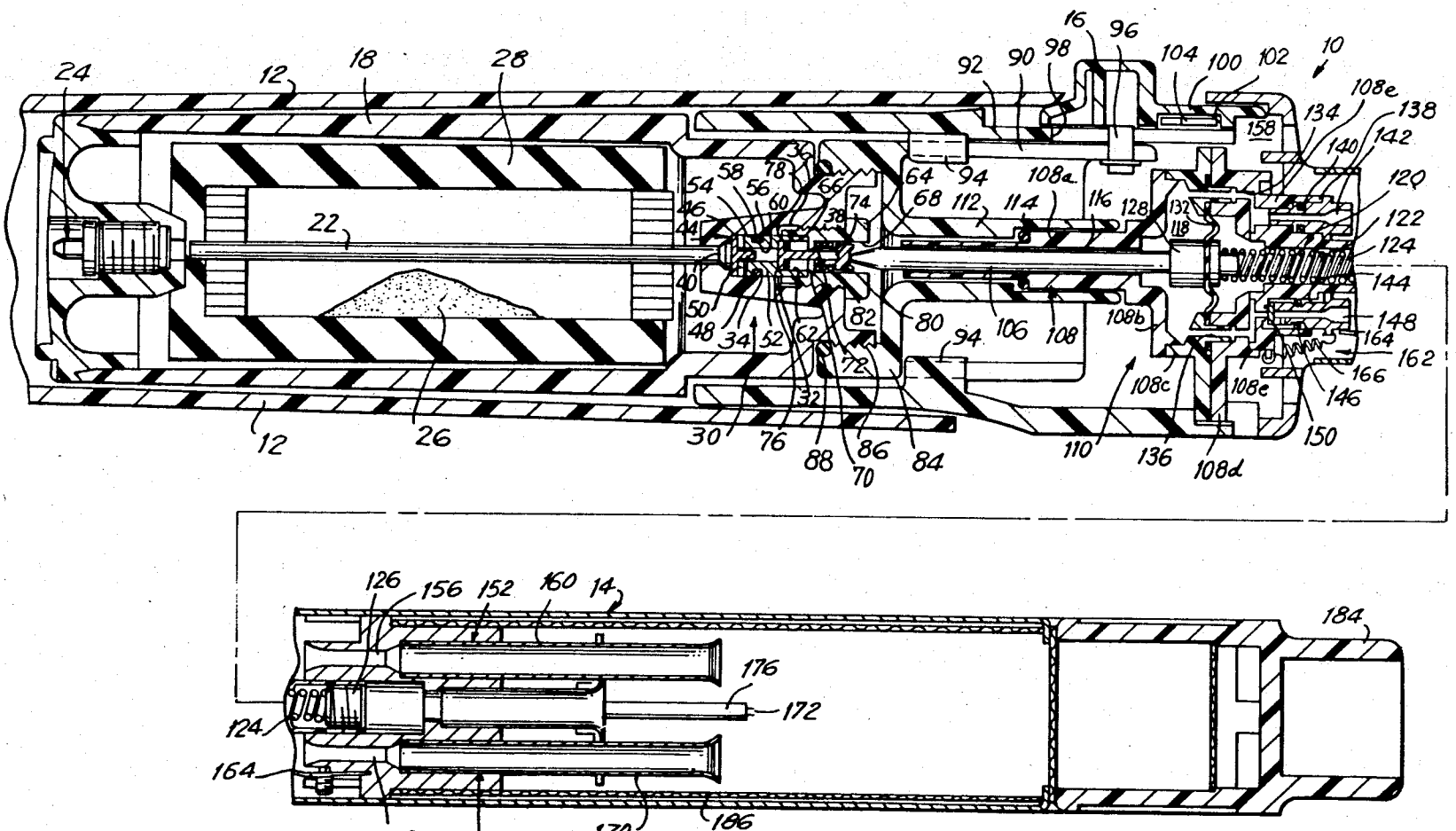
FIG. 2 is a partial cross-sectional view of the portable curling iron of FIG. 1, rotated by 90 degrees from FIG. 1.

Referring to the drawings in detail, a portable curling iron 10 according to the present invention includes a handle 12 which may serve as a cover over a barrel 14 thereof which is to be heated. Handle 12 is shown in FIGS. 1 and 2 in its operative condition, that is, removed from barrel 14. As shown in FIG. 2, when handle 12 is so positioned, it slides a switch button 16 to the right in FIG. 2 to the position shown. Switch button 16, as will be described in greater detail hereinafter, functions as an ON/OFF switch, to start the flow of a gas fuel, such as butane, from a fuel cartridge 18. Then, an ignitor push button 20 (FIG. 1) is depressed by the user to control a piezoelectric ignitor which ignites the butane to heat barrel 14.

As discussed, curling iron 10 is gas fueled, the gas being carried in fuel cartridge 18 and transported to the delivery end by a sintered plastic wick 22. Cartridge 18 may be refillable through a fill valve 24, or replaceable, as desired. As shown in FIG. 2, cartridge 18 includes a charcoal filter material 26 and a foam lining 28, as is conventional.

In addition, cartridge 18 includes a fuel delivery valve 30 at the end opposite fill valve 24. Specifically, fuel delivery valve 30 is assembled in a molded well 32 in the end of cartridge 18 which attaches to curling iron 10. Molded well 32 includes a smooth first section 34 having a first diameter, and a second section 36 having a second, larger diameter which is threaded as at 38.

Fuel delivery valve 30 includes an aluminum wick holder 40 press fit into the inner end of first section 34 of molded well 32. One end of sintered plastic wick 22 is pressed into wick holder 40 and the opposite end of wick 22 extends to near the bottom of cartridge 18 at the opposite end thereof. A cylindrical brass part 44 is positioned within well 32. Cylindrical brass part 44 includes a first section 46 adjacent wick holder 40 and having a diameter substantially equal to that of smooth first section 34, and a second shaft section 48 of a smaller diameter. A tube of compressible foam 50, which forms an adjustable flow restrictor, has a central opening and is located on second shaft section 48 of brass part 44, where the latter centers foam tube 50 within well 32. As will be appreciated from the discussion hereinafter, the degree of compression of foam tube 50 changes the flow rate of gas therethrough.

After the above has been assembled in well 32, the portion of fuel delivery valve 30 which compresses foam tube 50 is assembled in well 32. Specifically, a tubular brass spacer 52 having an outer diameter substantially equal to that of smooth first section 34 of well 32 is slidably fit therein. Spacer 52 includes an end face 54 which abuts against foam tube 50 to compress the same when a force is applied thereto. A circular groove 56 is formed in the outer surface of spacer 52 in which an O-ring 58 is inserted for preventing any leakage between the inner wall of well 32 and the outer surface of spacer 52. Spacer 52 includes a central bore 60 of substantially equal diameter to second shaft section 48 of cylindrical brass part 44 and which slidably fits thereover. Central bore 60 has an enlarged diameter, as at 62, at the opposite end thereof.

A cylindrical molded plastic upper valve housing 64 is provided with external threads which screw threadedly mate with threads 38 of second section 36 of well 32 for securing housing 64 therein. Housing 64 includes a first central, cylindrical recess 66 at one end which surrounds the outer surface of spacer 52, and a second central, cylindrical recess 68 at the opposite end, recesses 66 and 68 being separated by a wall 70 having a central aperture 72 therein. A stem 74 is slidably fit within aperture 72 and includes an enlarged head 76 on the end facing into cartridge 18, enlarged head 76 having an outer diameter substantially equal to that of enlarged diameter section 62 of central bore 60, but slidably fit therein. Thus, stem 74 is shaped like a tiny common nail, but with no sharp point. An annular rubber seal 78 is fit on stem 74 in abutment with enlarged head 76. The opposite end of stem 74 which extends to the opposite side of wall 70, is press fit into a plastic cap 80 which is slidably positioned within second cylindrical recess 68, plastic cap 80 being outwardly biased by a coil spring 82 also positioned within second cylindrical recess 68.

In operation, when no inwardly directed force is applied to plastic cap 80, coil spring 82 outwardly biases plastic cap 80, thereby causing annular rubber seal 78 to be biased to the right of FIG. 2 in contact with and sandwiched between enlarged head 76 and wall 70, to maintain annular rubber seal 78 in compression so as to prevent the flow of any gas from cartridge 18. As will be explained hereinafter, this occurs when cartridge 18 is not assembled with curling iron 10.

When an inwardly directed force is applied to plastic cap 80, the latter moves to the left of FIG. 2 to the position shown, compressing coil spring 82 and moving stem 74, enlarged head 76 and annular rubber seal 78 out of the sealing position, whereby gas can flow out of cartridge 18. The amount of gas flow will depend on the extent that foam tube 50 is compressed. It will be noted that, since housing 64 is screw threadedly received within well 32, the amount of leftward travel of stem 74 and enlarged head 76, and therefore the extent of compression of foam tube 50, will vary depending on the distance that housing 64 is screw threaded into well 32. Housing 64 is shown in FIG. 2 screw threaded to its maximum extent. The gas flow rate is preferably set at the factory and is not consumer adjustable.

As shown, cartridge 18 is secured to a sliding adapter 84 of curling iron 10 through screw threads 86 and is sealed with an O-ring 88 in a conventional manner. Sliding adaptor 84 includes an outer cylindrical section 90 which is slidably keyed within the proximal end of the housing 92 of curling iron 10 by at least one key element 94. Outer cylindrical section 90 is secured to switch button 16. Specifically, switch button 16 includes a switch knob pin 96 which extends through an elongated slot 98 in housing 92. Switch button 16 is also formed with a forward extension 100 having a recess 102 facing housing 92 and in which a switch spring 104 is placed to normally bias switch button 16 to the left of FIG. 2.

Accordingly, when handle 12 is inserted over the proximal end of curling iron 10, it moves switch button 16 to the right of FIG. 2 to the position shown. As a result, cartridge 18 is also moved to the right of FIG. 2 and, as will be described hereinafter, gas flow is started. When handle 12 is removed and placed over barrel 14 to function as a cover, switch spring 104 moves button 16 to the left of FIG. 2, thereby also moving cartridge 18 to the left, to stop the flow of gas.

Specifically, when cartridge 18 is moved to the right of FIG. 2, as shown, a plunger 106 hits against plastic cap 80 to move stem 74 and annular rubber seal 78 out of the aforementioned sealing arrangement to permit the flow of gas. When cartridge 18 is moved to the left of FIG. 2, plunger 106 no longer applies a depressing force to plastic cap 80. As a result, coil spring 82 biases plastic cap 80, stem 74, enlarged head 76 and annular rubber seal 78 to the right of FIG. 2 in the aforementioned sealing arrangement to prevent any flow of gas from cartridge 18.

Plunger 106 is slidably received within a regulator housing 108 of a regulator assembly 110 which, in turn, is slidably received within a central cylindrical section 112 of sliding adapter 84. An O-ring 114 provides a sliding seal between a first section 108*a* of regulator housing 108 and cylindrical section 112. Thus, gas can only flow from cartridge 18 through a gap 116 provided between plunger 106 and first section 108*a* of regulator housing 108.

The purpose of regulator assembly 110 is to provide vaporized fuel at constant pressure independent of ambient temperature, fuel consumption rate, orientation, brand of fuel and fuel level. Thus, a known amount of heat is produced at all times, corresponding to fuel consumption. Therefore, temperature regulation is not necessary to maintain barrel temperature during use and because of this, curling iron 10 according to the present invention is easier to assemble and adjust than prior butane curling irons.

As shown in FIG. 2, first section 108*a* of regulator housing 108 includes a radially directed section 108*b* at the end thereof which extends from cylindrical section 112. Radially directed section 108*b* is connected to a second section 108*c* of regulator housing 108 which, in turn, is connected to a third section 108*d* thereof. The latter section 108*d* is connected to still a fourth section 108*e* of regulator housing 108. Of course, all of the sections of regulator housing 108 can be constructed in a one piece molding operation. Radially directed section 108*b* and second, third and fourth sections 108*c*, 108*d* and 108*e*, respectively, define a gas flow chamber 118 through which gas flows from gap 116 between first section 108*a* of regulator housing 108 and plunger 106.

Regulator assembly 110 further includes an inner assembly 120 within chamber 118 and which defines a central bore 122 which houses a coil spring 124. An adjusting screw 126 is screw threadedly received within central bore 122, against which one end of coil spring 124 abuts. A plunger stopper 128 is secured to one end of plunger 106, and includes a central boss 130 at the opposite end thereof. The opposite end of coil spring 124 surrounds and is centered by boss 130 and abuts against the respective end face of plunger stopper 128. Thus, coil spring 124 pushes on plunger 106, biasing it in the direction of cartridge 18 into abutment with plastic cap 80 of fuel delivery valve 30 when cartridge 18 is secured to curling iron 10. Butane gas therefore flows from cartridge 18, through gap 116 to chamber 118.

A rubber diaphragm 132 is secured to inner assembly 120 and to plunger stopper 128. When the pressure of the fuel entering chamber 118 becomes too great, rubber diaphragm 132 is biased to the right of FIG. 2 against the force of coil spring 124, to move plunger 106 away from fuel delivery valve 30, whereby coil spring 82 of fuel delivery valve 30 causes it to close, halting the flow of gas. Once the gas pressure is reduced by burning the fuel, coil spring 124 moves rubber diaphragm 132 and plunger 106 to the left of FIG. 2 to the position shown, to once again open fuel delivery valve 30. This cycle continues and maintains a constant pressure on the outlet side of regulator assembly 110 as long as switch 16 remains in the ON position. It will be appreciated that, turning adjusting screw 126, alters the compression of coil spring 124, thus adjusting the gas flow pressure.

Regulator housing 108 and inner assembly 120 define two narrow channels 134 and 136 therebetween through which gas from chamber 118 escapes, each channel leading toward a respective orifice-venturi-burner assembly. Specifically, channel 134 leads to a valve stem 138 positioned within a recess defined between fourth section 108*e* of regulator housing 108 and inner assembly 120. An O-ring 140 surrounds valve stem 138 at mid-length to provide a gas tight seal. Valve stem 138 includes a central bore which defines a gas flow orifice 142 in fluid communication with channel 134.

In like manner, a valve stem 144 is positioned within a recess defined between fourth section 108*e* of regulator housing 108 and inner assembly 120, diametrically opposite valve stem 138. An O-ring 146 surrounds valve stem 144 at mid-length to provide a gas tight seal. In addition, valve stem 144 includes a central bore which defines a gas flow orifice 148 in fluid communication with channel 136. An annular, resilient valve pad 150 is positioned at the end of valve stem 144 between channel 136 and orifice 148. As will be appreciated from the description which follows, O-ring 146 acts as the fulcrum of a lever, whereby valve stem 144 can rotate or rock thereabout to make or break a seal between channel 136 and orifice 148, by means of valve pad 150. Thus, when valve stem 144 is axially in line with barrel 14, there is no gas seal, and butane vapors flow from channel 136, through the central aperture of valve pad 150 to orifice 148. On the other hand, when valve stem 144 is tilted or rotated about O-ring 146, the central aperture of valve pad 150 is out of line with channel 136 and orifice 148, so that a seal is provided which blocks the passage of gas to orifice 148.

The butane vapor from orifice 142 leads to a main burner 152, while the butane vapor from orifice 148 leads to a fast heat up burner 154. The burners differ in purpose, and each will be discussed beginning with main burner 152.

The purpose of main burner 152 is to provide enough heat to maintain barrel 14 at a desired temperature during use. After the butane vapor leaves orifice 142, it passes through a venturi tube 156, where air supplied from an annular chamber 158 is entrained to make a combustible mixture. Orifice 142 is of sufficient size to increase the velocity of the butane vapor so that the correct amount of air for efficient burning will be entrained in venturi tube 156. The size of the orifice determines how much fuel enters each burner at a given pressure. The amount of fuel determines the heat up rate and equilibrium temperature attained. The air-butane vapor mixture then travels down a stainless steel tube 160 to the opposite end thereof where ignition and combustion occur. There, the fuel is ignited by an electric spark when the ignition push button 20 is pressed, and burns as long as ON/OFF switch button 16 is ON.

The purpose of the fast heat up burner 154 is to reduce the time required to heat barrel 14 from ambient to working temperature. It differs from main burner 152 by virtue of a thermostatically controlled valve assembly 162 which allows fuel to flow until barrel 14 reaches a predetermined temperature at which point a bimetallic element 164 thereof, secured to barrel 14 and to valve stem 144, deflects, and a spring 166 secured to fourth section 108*e* of regulator housing 108 and valve stem 144, pivots valve stem 144 about O-ring 146, whereby valve pad 150 provides a seal to prevent fuel flow through orifice 148 of valve stem 144. When barrel 14 is not at the predetermined temperature, bimetallic element 164 applies a force to valve stem 144, normal to its axis and against the force of spring 166, to maintain orifice 148 of valve stem 144 in its open condition, whereby butane vapor enters orifice 148 and then travels through a venturi tube 168 where it is entrained with air from annular chamber 158. As with orifice 142, orifice 148 is of sufficient size to increase the velocity of the butane vapor so that the correct amount of air for efficient burning will be entrained in venturi tube 168. The air-fuel mixture from venturi tube 168 travels down a stainless steel tube 170 to the opposite end thereof where ignition and combustion occur. The heat produced by fast heat up burner 154 approximately doubles the heat output of curling iron 10. Of course, with orifice 148 closed by thermostatically controlled valve assembly 162, there is no combustion and therefore no heat.

Therefore, the burner system consists of two parallel paths, each with the same capacity, but one being controlled by regulator assembly 110 and bimetallic element 164 and the other being controlled by regulator assembly 110 alone. Each path terminates in a stainless steel tube 160 or 170 having an open end where the air-gas mixture is ignited and burned.

Ignition is accomplished by an electric spark traveling from electrodes 172 and 174 to the ends of stainless steel tubes 160 and 170, where combustion takes place, as shown in FIG. 1. Specifically, electrodes 172 and 174 are encased partially in ceramic tubes 176 and 178, respectively, with the ends thereof being exposed at the ends of stainless steel tubes 160 and 170, as shown. The opposite ends of electrodes 172 and 174 extend into electrical contact with a piezoelectric crystal 180 which generates a spark when struck by a spring loaded hammer 182 when ignition push button 20 is pressed. Ignition push button 20 is mounted between cartridge 18 and regulator assembly 110, measured in the lengthwise direction of curling iron 10, so that ignition push button 20 is next to ON/OFF switch button 16.

Thus, to operate curling iron 10, handle 12 is removed from barrel 14 and positioned over cartridge 18, where it biases switch button 16 to the right of FIG. 2, to turn ON the flow of butane gas. Then, ignition push button 20 is pressed once or twice to ignite the gas-air mixture at the end of stainless steel tubes 160 and 170. Initially, both burners 152 and 154 are activated to quickly bring barrel 14 up to the predetermined temperature. Once this temperature is attained, bimetallic element 164 deflects and spring 166 pivots valve stem 144 about O-ring 146 to prevent the flow of gas therethrough, and thereby shut off fast heat up burner 154. The predetermined temperature is then maintained by regulator assembly 110 which is initially set for the particular desired temperature. As the gas flow increases too much, whereby the temperature also rises, the gas flow is cut off, until the pressure in chamber 118 decreases (corresponding to the desired temperature).

A cool tip 184 is located on the open end of barrel 14. It is molded of high temperature resistant plastic which is also low in thermal conductivity. This component provides a gripping surface, and because it is tubular in shape, exhaust gases escape through its screened open end.

Further, the combustion area of curling iron 10 is surrounded by an expanded aluminum or wire woven screen 186. The purpose of screen 186 is to even out the temperature of the exhaust gases, all of which must pass through it. Additionally, exhaust ports (not shown) in barrel 14, which are conventional, have screens (not shown) of the same expanded aluminum, yielding a double flame arresting barrier against hot exhaust gases (even during ignition). Thus, curling iron 10 can be started and run in an explosive atmosphere of common household solvents with no danger of curling iron 10 starting a fire or explosion.

Although the present invention has been described for use with a curling iron, clearly, the fuel supply, regulator assembly and fast heat up and main burners are useable in many environments in which fast heat up and settable barrel temperatures are desirable. The following products are a representative list of those which could readily use the above elements either alone or in combination:

1. Curling iron
2. Travel setter
3. Facial hand unit
4. Travel flat iron
5. Travel flat iron with steam
6. Clothes dewrinkler
7. Contact lens sterilizer
8. Travel hot plate
9. Hot tray
10. Gas match
11. Lantern
12. Bottle warmer
13. Hot liquids container
14. Hot bladed knife
15. Solder iron
16. Hot melt gun
17. Travel stove
18. Pocket hands warmer
19. Paint stripper
20. Heat massager It will also be appreciated that the regulator assembly has independent value and can be used without the two burner system. In like manner, the two burner system can be used without the regulator assembly.

In the embodiment of FIGS. 1 and 2, when handle 12 is inserted over the proximal end of curling iron 10, it moves switch button 16 to the right of FIG. 2 to the position shown. As a result, cartridge 18 is also moved to the right of FIG. 2, whereby gas flow is started. However, this movement of cartridge 18 may be undesirable from a user's standpoint, since a user may believe that the system is faulty, broken or the like.

Figure 3:
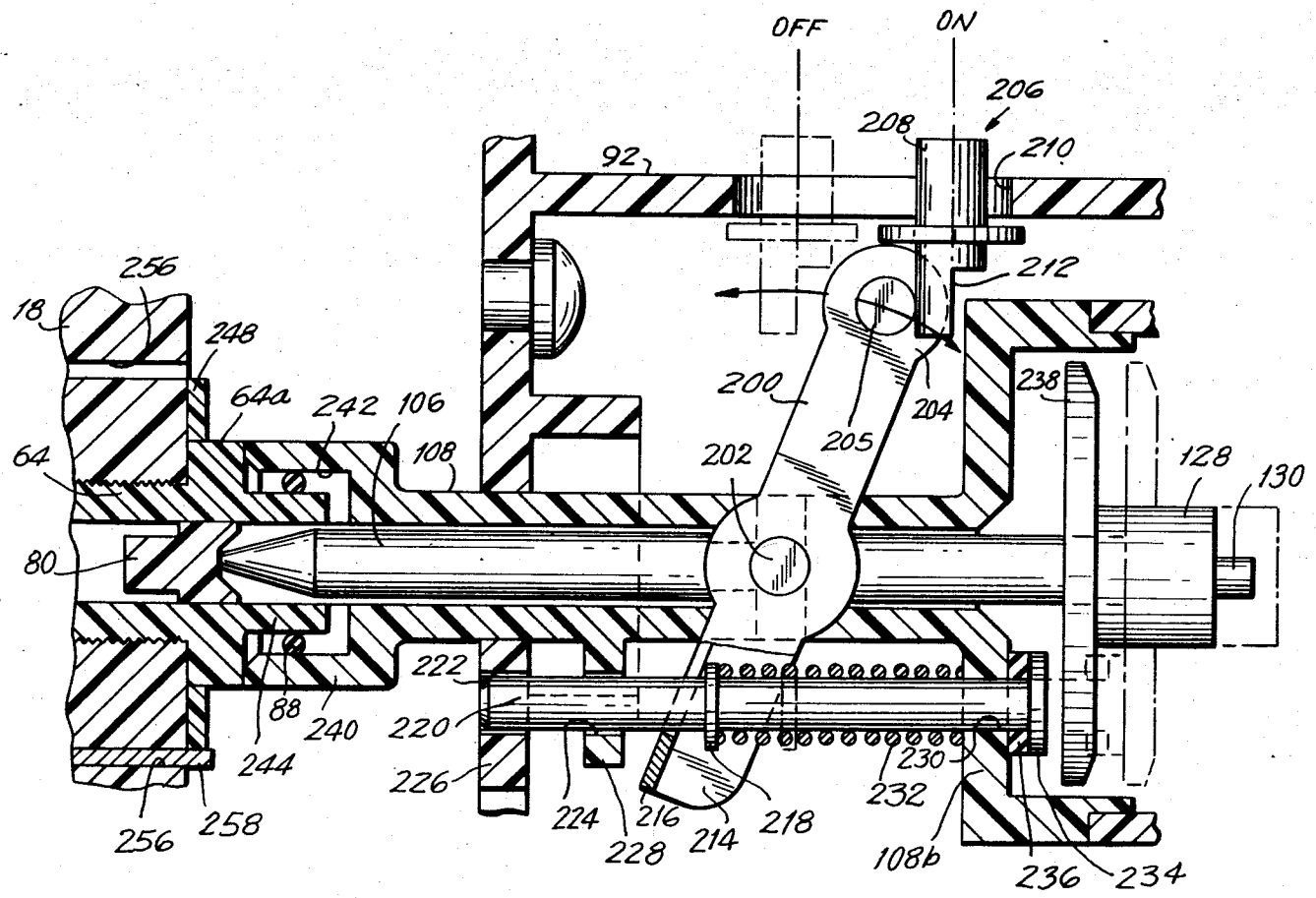
FIG. 3 is a schematic, cross-sectional view of a modification of a portion of the portable curling iron of FIG. 1.

Referring now to FIG. 3, there is shown a modification of a portion of the apparatus of FIGS. 1 and 2, in which like parts are represented by the same numerals and a detailed description of such like elements will be omitted herein for the sake of brevity. The FIG. 3 modification is designed to overcome the aforementioned disadvantage of the embodiment of FIGS. 1 and 2.

Figure 4:
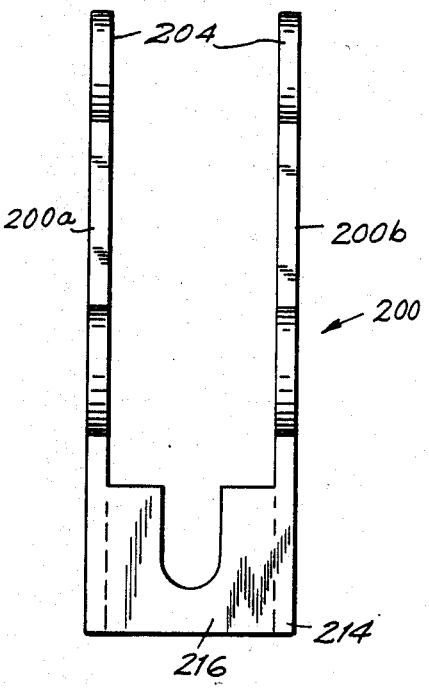
FIG. 4 is a plan view of the lever of FIG. 3.

Specifically, in the embodiment of FIG. 3, cartridge 18 is always stationary with respect to the housing, and instead, plunger 106 is caused to move with respect to stationary cartridge 18. As shown, a lever 200 is pivotally mounted substantially midway along the length thereof by pivot pins 202 within the housing. It is preferable that the axis of pivot pins 202 be transverse to and intersect the axis of plunger 106, as shown in FIG. 3. Lever 200 is shown in FIG. 4 to have a bifurcated configuration, whereby pivot pins 202 pivotally mount each leg 200*a* and 200*b* thereof. As shown in FIG. 3, the upper end 204 of lever 200 includes a roller 205 rotatably secured thereto between legs 200*a* and 200*b*, with roller 205, and thereby lever 200, being pivotally biased about pivot pin 202 by a switch button 206, which replaces switch button 16 in FIGS. 1 and 2. Switch button 206 includes a switch knob pin 208 which extends through and is slidably received in an elongated slot 210 in housing 92. Switch knob pin 208 includes a reduced dimension section 212 at the lower end thereof which abuts against roller 205, such that when switch button 206 is moved to the dashed line position shown in FIG. 3, reduced dimension section 212 will rotate lever 200 counter-clockwise about pivot pin 202.

The opposite, lower end 214 of lever 200 includes a transverse connecting section 216 which secures legs 200*a* and 200*b* together and which normally abuts against a ring 218 secured about a shaft 220. In this regard, connecting section 216 includes a cut-out section 216*a* for receiving shaft 220. Shaft 220 is axially movable and is supported at one end within an aperture 222 of a support section 226, the latter being secured to the housing. Shaft 220 is also supported through an aperture 224 of a midway flange 228 of regulator housing 108, and at the other end, through an aperture 230 extending through radially directed section 108*b* of regulator housing 108. A coil spring 232 surrounds shaft 220, and is positioned between radially directed section 108*b* of regulator housing 108 and ring 218 for normally biasing shaft 220 to the left of FIG. 3.

As shown in FIG. 3, a ring 234 is secured around the extreme end of shaft 220 as it extends through aperture 230, and a gasket 236 is secured around shaft 220 and to the inner surface of ring 234. Thus, when spring 232 biases shaft 220 to the left of FIG. 3, to the position shown, gasket 236 provides a seal against leakage of gas to the outside through aperture 230. Further, a ring 238 or similar abutment member is secured to plunger 106 immediately in front of plunger stopper 128.

In operation, when switch button 206 is moved to the solid line position, to the right of FIG. 3, by handle 12 or by user actuation, shaft 220 is no longer biased by lever 200. Accordingly, coil spring 232 biases shaft 220 to the left of FIG. 3, to the position shown. As a result, ring 218 secured to shaft 220 abuts against flange 216 and pivots lever 200 clockwise about pivot pin 202 to the position shown, so that roller 205 is in abutting relation to switch button 206. In such position, coil spring 124 (not shown in FIG. 3) biases plunger stopper 128 and thereby plunger 106 to the left of FIG. 3 against plastic cap 80 to start the flow of gas in an identical manner to that described above with respect to FIGS. 1 and 2.

When switch button 206 is moved to the dashed line position, to the left of FIG. 3, reduced dimension section 212 thereof abuts against roller 205 and pivots lever 200 counter-clockwise about pivot pin 202. As a result, flange 216 at the lower end 214 of lever 200 abuts against ring 218 and biases shaft 220 to the right of FIG. 3, against the force of coil spring 232. Thus, ring 234 abuts against and biases ring 238, and thereby plunger 106, to the dashed line position to the right of FIG. 3. Accordingly, plunger 106 no longer pushes in plastic cap 80, so that the flow of gas is stopped. It will be appreciated that in the OFF position, suitable means is provided for locking switch button 206 in the dashed line OFF position. For example, this may take the form of a transverse notch extending from slot 210 in which switch button 206 can be positioned, so that coil spring 232 does not move switch button 206 to the ON position when the force used to move it to the OFF position has been released.

Thus, with the embodiment of FIG. 3, plunger 106, rather than cartridge 118, is moved to start the flow of gas, thereby overcoming the aforementioned disadvantage with the embodiment of FIGS. 1 and 2.

It will be appreciated that, in the embodiment of FIG. 3, the assembly for moving plunger 106 is located on the left, high pressure side of the diaphragm. However, according to the present invention, any suitable arrangement for moving plunger 106 could be located on the right, low pressure side of the diaphragm.

Another modification of the embodiment of FIGS. 1 and 2 will now be described with respect to FIG. 3. Specifically, in the embodiment of FIGS. 1 and 2, cartridge 18 is threadedly secured to a sliding adapter 84 through screw threads 86 and is sealed with an O-ring 88. This arrangement, however, may be disadvantageous since continual adjustment between the threaded members may cause a slight loosening therebetween, thereby causing a slight leakage around O-ring 88. Further, positioning of O-ring 88 at the point of connection between the parts, may be disadvantageous.

In the embodiment of FIG. 3, since cartridge 18 no longer slides, as described above, sliding adapter 84 is replaced by an annular extension 240 of regulator housing 108, extension 240 including a smooth inner surface 242 which replaces screw threads 86 of the embodiment of FIGS. 1 and 2. Extension 240 surrounds an annular flange 244 of housing 64 extending from cartridge 18, with a small gap therebetween. The outer surface of annular flange 244 is smooth. The screw threads of cartridge 18 are thereby eliminated. Extension 240 abuts against the end of housing 64 to which annular flange 244 is secured, as shown, to positionally fix the relationship between cartridge 18 and regulator housing 108. When this fixed relationship is established, the positional relationship between plunger 106 and plastic cap 80 also is fixed, whereby the amount of travel of plunger 106 is always the same, and therefore, the flow rate, the pressure on the vaporizer and the general gas pressures throughout the regulator assembly are fixed and are not variable. Thus, there are predictability and reliability in the operation of the burner system, as well as the rate of flow and type of flow from cartridge 18.

Further, O-ring 88 is positioned in the gap between the outer surface of annular extension 244 and inner surface 242 of extension 240 in a sealing relation. Thus, because of the fixed relation of these surfaces with respect to each other, there is no problem of the seal deteriorating, as with the threaded arrangement of FIGS. 1 and 2. Further, the seal is between two walls or surfaces, and not at the junction point between two members, so that the reliability of the seal is further increased.

A further modification will now be discussed with respect to FIGS. 3 and 5. Specifically, in the embodiment of FIGS. 1 and 2, upper valve housing 64 is provided with external threads which screw threadedly mate with threads 38 of second section 36 of well 32 for securing housing 64 therein. Thus, the amount of leftward travel of stem 74 and enlarged head 76, and therefore the extent of compression of foam tube 50, will vary depending on the distance that housing 64 is screw threaded into well 32.

It is important that foam tube 50, which functions as a vaporizer, maintains a steady control over the conversion of liquid butane into vapor so as to ensure proper operation of the burner assembly. In this regard, the gas flow rate is preferably set at the factory and is not consumer adjustable. This is accomplished by setting the extent that housing 64 is screw threaded into well 32.

However, since cartridge 18 is replaceable, as the cartridge is inserted in and out of the assembly, housing 64 may loosen. As a result, the pressure on vaporizer or foam tube 50 changes so that control of the fuel flowing to the burner assembly becomes unpredictable and unreliable.

Figure 5:
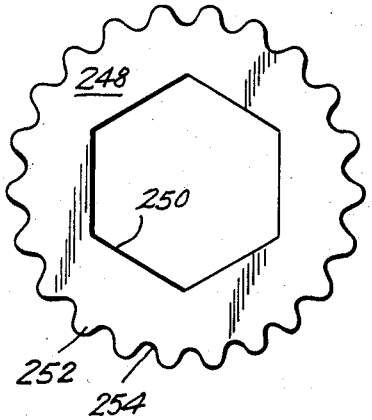
FIG. 5 is a plan view of the nozzle holder stopper of FIG. 3.

In accordance with the further modification of the present invention as shown in FIGS. 3 and 5, housing 64, which has a hex head **64*a*, is fixed, so that it can not accidentally rotate. Specifically, a thin, substantially circular, plastic nozzle holder stopper 248 is provided in surrounding relation to the hex head 64*a* of housing 64. Nozzle holder stopper 248 has an internal hex aperture 250 which fits about hex head 64*a*, and a convoluted external surface 252 with a plurality of teeth 252 which define a plurality of recessed sections 254. The end wall of cartridge 18, against which nozzle holder stopper 248 rests, is provided with at least one, and preferably four, apertures 256, aligned with the recessed sections 254. In this regard, a stop pin 258 inserted through any aperture 256 will prevent rotation of nozzle holder stopper 248, and thereby, of housing 64. As a result, the pressure on foam tube 50 is fixed at all times and will not change, even if cartridge 18** is repeatedly taken out of and inserted back in the apparatus.

Figure 6:
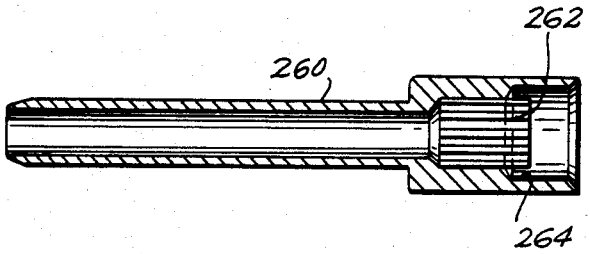
FIG. 6 is a cross-sectional view of a modified burner tube according to the present invention.
Figure 7:
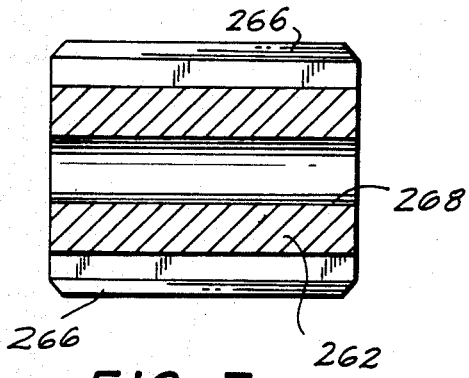
FIG. 7 is a cross-sectional view of a burner nozzle inserted within the burner tube of FIG. 6.
Figure 8:
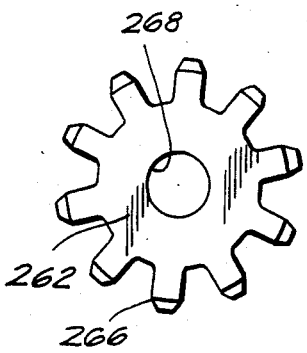
FIG. 8 is an end plan view of the burner nozzle of FIG. 7.

Referring now to FIGS. 6–8, there is shown a further modification of the embodiment of FIGS. 1 and 2. Specifically, in the embodiment of FIGS. 1 and 2, burner tubes 160 and 170 may conduct heat from the burner or right end of FIG. 1 back to the opposite, gas supply end. This, however, may alter the venturi gas/air mixture, resulting in an unpredictability as to the gas/air mixture and an unevenness in the burner operation.

In order to overcome this, a modified burner assembly is provided, as shown in FIGS. 6–8. Specifically, with the burner tube 260 of FIG. 6, the left end is connected with venturi tube 156 and the burning operation occurs at the right end of the burner tube 260. In accordance with the modification, a burner nozzle 262 is set into the right end of burner tube 260. Preferably, burner nozzle 262 extends 1.5 mm into the recessed area 264 of burner tube 260. As shown in FIGS. 6 and 7, burner nozzle 262 has a substantially cylindrical configuration, with a plurality of equally spaced gear-like teeth 266 extending in the lengthwise direction on the outer surface of burner tube 260. An axially aligned central aperture 268 is also provided. With this modification, the operation of burner tube 260 is cleaner and more efficient with an improved flame. Further, there is a reduction in the conduction of heat back toward the gas supply end, thereby reducing any unpredictability and unevenness of the gas/air mixture as it enters burner tube 260.

Having described specific preferred embodiments of the invention with reference to the accompanying drawings, it is to be appreciated that the present invention is not limited to those precise embodiments and that various changes and modifications can be effected therein by one of ordinary skill in the art without departing from the spirit and scope of the invention as defined by the appended claims.

What is claimed is:

1. A portable heating appliance having a member to be heated, comprising:

burner means for heating said member;

fuel supply means for supplying fuel to said burner means, said fuel supply means including stationary fuel delivery valve means for controlling the flow of fuel from said fuel supply means; and actuator means for actuating said fuel delivery valve means in response to user actuation to start the flow of fuel from said fuel supply means, said actuator means including a plunger, means for applying a continuous force to move said plunger to a first position into operative engagement with said fuel delivery valve means for opening said fuel delivery valve means and means for moving said plunger to a second position out of operative engagement with said fuel delivery valve means so that the latter terminates the flow of fuel to said burner means;

said means for moving said plunger to a second position includes a pivotally mounted lever, spring means for biasing said lever in a first direction, switch means for biasing said lever in a second, opposite direction against the force of said spring means, abutment means secured to said plunger, said abutment means movable by said lever to move said plunger to said second position when said switch means biases said lever in said second direction.

2. A portable heating appliance having a member to be heated, comprising:

burner means for heating said member;

fuel supply means for supplying fuel to said burner means, said fuel supply means including stationary fuel delivery valve means for controlling the flow of fuel from said fuel supply means; and actuator means for actuating said fuel delivery valve means in response to user actuation to start the flow of fuel from said fuel supply means, said actuator means including a plunger, means for moving said plunger to a first position into operative engagement with said fuel delivery valve means for opening said fuel delivery valve means and means for moving said plunger to a second position out of operative engagement with said fuel delivery valve means so that the latter terminates the flow of fuel to said burner means;

said means for moving said plunger to a second position includes a pivotally mounted lever, spring means for biasing said lever in a first direction, switch means for biasing said lever in a second, opposite direction against the force of said spring means, abutment means secured to said plunger, and slidably mounted shaft means movable by said lever into engagement with said abutment means to move said plunger to said second position when said switch means biases said lever in said second direction.

3. A portable heating appliance according to claim 2; further including a regulator housing, and a restraining member fixed on said shaft means; and wherein said spring means includes a coil spring surrounding said shaft means and positioned between said regulator housing and said restraining means for normally biasing said shaft means in a direction away from said regulator housing.

4. A portable heating appliance according to claim 3; wherein said shaft means is slidably received within an aperture of said regulator housing; and further including gasket means secured to said shaft means for sealing said aperture of said regulator housing when said shaft means is biased in a direction away from said aperture of said regulator housing.

5. A portable heating appliance according to claim 3; wherein said fuel supply means includes a cartridge, said fuel delivery valve means includes valve housing means having a head extending from said cartridge and an annular flange extending from said head; and said regulator housing includes an annular extension surrounding said annular flange with a gap therebetween and being in abutting relation with said head; and further comprising sealing means positioned in said gap to seal the same.

6. A portable heating appliance according to claim 5; wherein said sealing means includes an O-ring.

7. A portable heating appliance having a member to be heated, comprising:

burner means for heating said member;

fuel supply means for supplying fuel to said burner means, said fuel supply means including stationary fuel delivery valve means for controlling the flow of fuel from said fuel supply means; and actuator means for actuating said fuel delivery valve means in response to user actuation to start the flow of fuel from said fuel supply means, said actuator means including a plunger, means for moving said plunger to a first position into operative engagement with said fuel delivery valve means for opening said fuel delivery valve means and means for moving said plunger to a second position out of operative engagement with said fuel delivery valve means so that the latter terminates the flow of fuel to said burner means;

said means for moving said plunger to said first position includes biasing means for applying a force to said plunger, wherein said biasing means constantly applies said force to said plunger to bias the latter into engagement with said fuel delivery valve means to control the latter to permit the flow of fuel from said fuel supply means.

8. A portable heating appliance according to claim 7; further including regulator means for controlling said actuator means to maintain a substantially constant flow rate of fuel to said burner means.

9. A portable heating appliance according to claim 8; wherein said regulator means includes diaphragm means for applying a force to said plunger against the force from said biasing means when the pressure of said fuel from said fuel supply means is greater than a predetermined pressure to control said fuel delivery valve means to prevent the flow of fuel from said fuel supply means.

10. A portable heating appliance according to claim 7; wherein said actuator means includes means for adjusting the force applied by said biasing means to said plunger.

11. A portable heating appliance having a member to be heated, comprising:

burner means for heating said member;

fuel supply means for supplying fuel to said burner means, said fuel supply means including stationary fuel delivery valve means for controlling the flow of fuel from said fuel supply means; and actuator means for actuating said fuel delivery valve means in response to user actuation to start the flow of fuel from said fuel supply means, said actuator means including a plunger, means for moving said plunger to a first position into operative engagement with said fuel delivery valve means for opening said fuel delivery valve means, said means for moving said plunger to said first position includes biasing means for applying a force to said plunger to bias the latter into engagement with said fuel delivery valve means to control the latter to permit the flow of fuel from said fuel supply means, said biasing means includes a coil spring applying a force against said plunger, means for moving said plunger to a second position out of operative engagement with said fuel delivery valve means so that the latter terminates the flow of fuel to said burner means, and means for adjusting the force applied by said biasing means to said plunger, said means for adjusting including an adjusting screw against which one end of said coil spring abuts and which is adjustable to vary the force applied by said coil spring to said plunger.

12. A portable heating appliance according to claim 1; wherein said fuel delivery valve means includes valve housing means in one end of said fuel supply means, said valve housing means including an aperture through which said fuel escapes from said fuel supply means, valve pad means movable to a first position for preventing the flow of fuel through said aperture and to a second position for permitting the flow of fuel through said aperture, and stem means for moving said valve pad means between said first and second positions in response to movement of said plunger.

13. A portable heating appliance according to claim 12; wherein said fuel delivery valve means further includes restrictor means for varying the amount of fuel supplied by said fuel supply means in response to the force applied by said plunger through said stem means.

14. A portable heating appliance according to claim 13; wherein said restrictor means includes a compressible foam tube which is compressed to an extent depending on the force applied thereto by said plunger.

15. A portable heating appliance according to claim 12; wherein said fuel supply means includes a fuel supply cartridge, and said valve housing means includes a head extending from said cartridge; and further comprising a nozzle holder stopper surrounding said head for preventing rotation thereof, said nozzle holder stopper having at least one cut-away section, said cartridge having at least one aperture in alignment with said at least one cut-away section, and at least one pin extending through said at least one cut-away section and said at least one aperture in said cartridge for rotatably fixing said nozzle holder stopper and said valve housing means with respect to said cartridge.

16. A portable heating appliance according to claim 15; wherein said nozzle holder stopper has an outer circumferential surface and said at least one cut-away section includes at least one recess in said outer circumferential surface.

17. A portable heating appliance according to claim 1; wherein said burner means includes at least one hollow burner tube having a first end supplied with fuel from said fuel supply means and a second, opposite end at which a burning operation occurs, each burner tube having a central bore extending therethrough from said first end to said second end, said bore having a larger diameter at said second end, and at least one burner nozzle, each having a central bore extending therethrough positioned in said central bore of each burner tube at said second end thereof.

18. A portable heating appliance according to claim 17; wherein each said burner nozzle includes a plurality of gear-like teeth extending longitudinally along an outer surface thereof.

19. A portable heating appliance having a member to be heated, comprising:

first and second burner means for heating said member;

fuel supply means for supplying fuel to said burner means, said fuel supply means including stationary fuel delivery valve means for controlling the flow of fuel from said fuel supply means;

actuator means for actuating said fuel delivery valve means in response to user actuation to start the flow of fuel from said fuel supply means, said actuator means including a plunger, means for moving said plunger to a first position into operative engagement with said fuel delivery valve means for opening said fuel delivery valve means and means for moving said plunger to a second position out of operative engagement with said fuel delivery valve means so that the latter terminates the flow of fuel to said burner means; and means for terminating the flow of fuel to said second burner means when a predetermined temperature is reached.

20. A portable heating appliance according to claim 19; further comprising conduit means for carrying said fuel from said fuel supply means to said first and second burner means; and said means for terminating includes means for preventing the flow of fuel through said conduit means to said second burner means.

21. A portable heating appliance according to claim 20; wherein said conduit means includes first valve stem means for carrying said fuel from said fuel supply means to said first burner means and second valve stem means for carrying said fuel from said fuel supply means to said second burner means, said second valve stem means being movable between a first position to permit the flow of fuel from said fuel supply means to said second burner means and a second position to prevent the flow of fuel from said fuel supply means to said second burner means; and wherein said means for terminating includes first biasing means for moving said second valve stem means to said first position when the temperature is less than said predetermined temperature and second biasing means for moving said second valve stem means to said second position when the temperature is at least equal to said predetermined temperature.

22. A portable heating appliance according to claim 20; wherein said second valve stem means includes a fuel flowing orifice; and further including channel means for supplying said fuel from said fuel supply means to said orifice of said second valve stem means, and valve pad means positioned between said channel means and said orifice for permitting the flow of fuel to said orifice when said second valve stem means is in said first position and for preventing the flow of fuel to said orifice when said second valve stem means is in said second position.

23. A portable heating appliance according to claim 20; wherein said first biasing means includes a bimetallic element which biases said second valve stem means to said first position when said temperature is less than said predetermined temperature and which removes said bias when the temperature is at least equal to said predetermined temperature; and said second biasing means includes spring means which biases said second valve stem means to said second position when the temperature is at least equal to said predetermined temperature and said bimetallic element removes said bias therefrom.

* * * * *